US008508428B2

(12) United States Patent
Ollikainen et al.

(10) Patent No.: US 8,508,428 B2
(45) Date of Patent: Aug. 13, 2013

(54) ANTENNA ARRANGEMENT

(75) Inventors: Jani Ollikainen, Helsinki (FI); Juha Villanen, Espoo (FI); Jari Petteri Holopainen, Espoo (FI); Clemens Icheln, Espoo (FI); Pertti Vainikainen, Helsinki (FI)

(73) Assignee: Nokia Corporation, Espoo (FI)

( * ) Notice: Subject to any disclaimer, the term of this patent is extended or adjusted under 35 U.S.C. 154(b) by 912 days.

(21) Appl. No.: 12/532,179

(22) PCT Filed: Mar. 30, 2007

(86) PCT No.: PCT/IB2007/002081

§ 371 (c)(1),
(2), (4) Date: Nov. 23, 2009

(87) PCT Pub. No.: WO2008/120038

PCT Pub. Date: Oct. 9, 2008

(65) Prior Publication Data

US 2010/0073253 A1 Mar. 25, 2010

(51) Int. Cl.
*H01Q 9/00* (2006.01)
*H01Q 1/48* (2006.01)

(52) U.S. Cl.
USPC ..... 343/850; 343/702; 343/846

(58) Field of Classification Search
USPC ..... 343/700 MS, 702, 846, 848, 850, 343/860
See application file for complete search history.

(56) References Cited

U.S. PATENT DOCUMENTS

| | | | | |
|---|---|---|---|---|
| 6,181,287 | B1 * | 1/2001 | Beigel | 343/741 |
| 6,621,466 | B2 | 9/2003 | Kuck | 343/846 |
| 7,616,158 | B2 * | 11/2009 | Mak et al. | 343/700 MS |
| 7,701,350 | B2 * | 4/2010 | Sakama et al. | 340/572.7 |
| 8,179,333 | B2 * | 5/2012 | Rajanish et al. | 343/795 |
| 2004/0203529 | A1 | 10/2004 | Hong et al. | 455/90.3 |
| 2006/0258414 | A1 | 11/2006 | Vance et al. | 455/575.7 |
| 2008/0180254 | A1 * | 7/2008 | Kajander | 340/572.7 |

FOREIGN PATENT DOCUMENTS

WO WO 2006/057275 A1 1/2006

* cited by examiner

*Primary Examiner* — Tan Ho
(74) *Attorney, Agent, or Firm* — Harrington & Smith

(57) ABSTRACT

An antenna arrangement including a partitioned ground plane including at least a first part and a second part that are interconnected by a component having a predetermined impedance; and an inductive coupling element positioned adjacent the component.

20 Claims, 5 Drawing Sheets

ANTENNA ARRANGEMENT

FIELD OF THE INVENTION

Embodiments of the present invention relate to an antenna arrangement and/or a method. In particular, they relate to a low-volume, wideband antenna arrangement.

BACKGROUND TO THE INVENTION

It is generally desirable to create antenna arrangements that occupy low volumes so that they can be easily integrated within electronic devices or modules for electronic devices.

As the volume of an antenna arrangement decreases the bandwidth of the antenna arrangement at its lower resonant frequency can decrease.

It is therefore difficult to obtain a low volume antenna arrangement that has satisfactory performance.

BRIEF DESCRIPTION OF THE INVENTION

According to some embodiments of the invention there is provided an antenna arrangement comprising: a partitioned ground plane comprising at least a first part and a second part that are interconnected by a component having a predetermined impedance; and an inductive coupling element positioned adjacent the component.

The interconnection of the first part of the ground plane with the second part of the ground plane using a component controls the electrical length of the ground plane and its resonant frequencies. Electric currents flowing within the ground plane between the first part and the second part are channelled through the component. The use of an inductive coupling element adjacent this 'channel' enables strong inductive coupling between the ground plane and the coupling element.

According to some embodiments of the invention there is provided an antenna arrangement comprising: a chassis tuned to a predetermined resonant frequency using an incorporated component having a predetermined impedance; and a conductive element, having a RF feed, positioned adjacent the component.

According to some embodiments of the invention there is provided a method comprising: partitioning a ground plane into a first part and a second part; interconnecting the first part and the second part using a component having a predetermined impedance; and providing an inductive coupling element adjacent the component.

According to some embodiments of the invention there is provided a method comprising: using an inductive coupling element adjacent a component to excite a resonant mode of a ground plane that is partitioned into first and second parts interconnected via the component.

BRIEF DESCRIPTION OF THE DRAWINGS

For a better understanding of the present invention reference will now be made by way of example only to the accompanying drawings in which.

DETAILED DESCRIPTION OF EMBODIMENTS OF THE INVENTION

Figure 1:
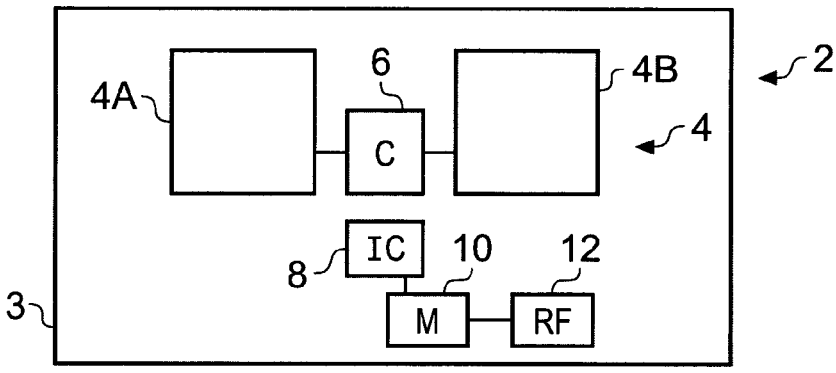
FIG. 1 schematically illustrates an electronic device or a module for an electronic device comprising an antenna arrangement.

FIG. 1 schematically illustrates an electronic device 3 such as a portable electronic device or wireless communication device or a module for such an electronic device.

The device (or module) 3 comprises an antenna arrangement 2 for transmitting and/or receiving radio frequency (RF) communication signals.

The illustrated antenna arrangement 2 is a low-volume, low-profile antenna arrangement that has a wide operational bandwidth at a resonant frequency. This may enable use of the antenna arrangement 2 for communication in one or more communication bands that lie within that bandwidth.

Examples of suitable communication bands include: AM radio (0.535-1.705 MHz); FM radio (76-108 MHz); Bluetooth (2400-2483.5 MHz); WLAN (2400-2483.5 MHz); HLAN (5150-5850 MHz); GPS (1570.42-1580.42 MHz); US-GSM 850 (824-894 MHz); EGSM 900 (880-960 MHz); EU-WCDMA 900 (880-960 MHz); PCN/DCS 1800 (1710-1880 MHz); US-WCDMA 1900 (1850-1990 MHz); WCDMA 2100 (Tx: 1920-1980 MHz Rx: 2110-2180 MHz); PCS1900 (1850-1990 MHz); UWB Lower (3100-4900 MHz); UWB Upper (6000-10600 MHz); DVB-H (470-702 MHz); DVB-H US (1670-1675 MHz); DRM (0.15-30 MHz); Wi Max (2300-2400 MHz, 2305-2360 MHz, 2496-2690 MHz, 3300-3400 MHz, 3400-3800 MHz, 5250-5875 MHz); DAB (174.928-239.2 MHz, 1452.96-1490.62 MHz); RFID LF (0.125-0.134 MHz); RFID HF (13.56-13.56 MHz); RFID UHF (433 MHz, 865-956 MHz, 2450 MHz).

Some embodiments of the antenna arrangement 2 are particularly suitable for enabling communication in the US-GSM 850 band (824-894 MHz) and the EGSM 900 band (880-960 MHz). It can be particularly difficult to design a low volume antenna arrangement that covers both of these bands with a single wideband resonance.

The antenna arrangement 2 comprises a chassis 4 that operates as a ground plane. The chassis (ground plane) 4 is partitioned and comprises a first part 4A and a second part 4B that is distinct from the first part. The first part 4A and the second part 4B are interconnected by a component 6.

The component 6, incorporated in the chassis 4, has a predetermined impedance that is used to tune the electrical length of the chassis 4 to a predetermined electrical length. Tuning the electrical length of the chassis tunes a resonant mode of the chassis to a predetermined resonant frequency.

An inductive coupling element 8 is positioned adjacent the component 6 and is connected via a matching circuit 10 to a RF feed 12. The inductive coupling element 8 excites resonant modes of the partitioned chassis (ground plane) by generating magnetic fields at the component 6 and the chassis 4. (If the electrical length of the chassis (ground plane) is K and the order of a resonant mode is given by n, then the wavelength λ of the resonant modes may be represented by $K=n\lambda/2$ where n=1, 2, 3 . . . )

Although the inductive coupling element 8 may excite a plurality of resonant modes of different order in the partitioned chassis (ground plane) 4, for the lowest (n=1) resonant mode the partitioned chassis (ground plane) 4 may operate as an antenna radiator fed via the inductive coupling element 8.

The inductive coupling element 8 must be placed in close proximity to the component 6 to achieve good coupling and it is typically located within 5 mm or even 3 mm of the component 6.

Figure 2:
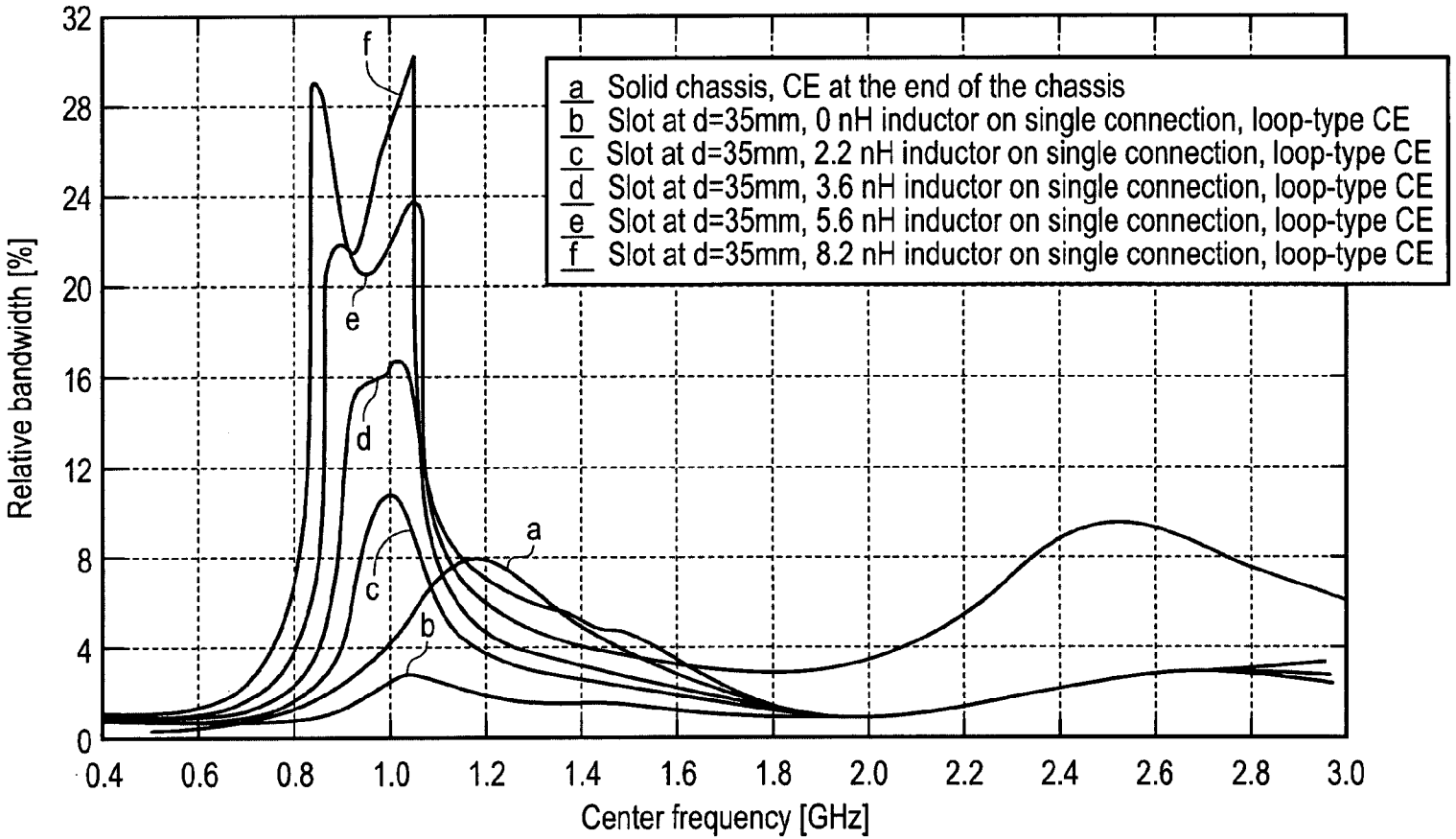
FIG. 2 illustrates the effect of the component on the bandwidth of the antenna arrangement at the lowest resonant mode.

The effect of the component 6 on the bandwidth potential of the antenna arrangement 2 at the lowest resonant mode is illustrated in FIG. 2. In the illustrated examples c-f an inductor of increasing inductance is used as the component 6. As the inductance of the component 6 is increased the electrical length K of the chassis (ground plane) 4 is increased. This decreases the resonant frequency of the lowest resonant mode. The currents of the chassis wavemode concentrate more and more on the area of the component 6. At the same time, the magnetic fields circulating the chassis 4 become more and more concentrated in the area of the component 6, and thus near the inductive coupling element 8. This results in an increased coupling between the inductive coupling element 8 and the resonant wavemode of the chassis 4, which increases bandwidth potential for the resonant frequencies.

Bandwidth potential as a function of frequency may, in one instance, be defined as the 6 dB relative bandwidth obtained when the input impedance of the inductive coupling element 8 is matched to 50Ω at each frequency by a lossless two-component matching circuitry.

The component 6 may be a lumped component such as an inductor or a capacitor, a combination of lumped components such as an LC (series or parallel) resonant circuit or another element such as a meandering interconnect between the first part 4A and the second part 4B.

If the physical length L of the chassis (ground plane) 4 corresponds to 10 cm, then by using an inductor as the component 6 the electrical length K of the chassis (ground plane) 4 can be increased making it suitable for EGSM when the inductance value exceeds 3.6 nH and suitable for both US-GSM and EGSM when the inductance value is 8.3 nH.

Using a capacitor instead of an inductor decreases the electrical length K of the ground plane 4. This shifts the resonant frequency upwards. It may, for example, cover DVB-H US (1670-1675 MHz) or PCN/DCS 1800 (1710-1880 MHz).

The use of an LC resonant circuit (series or parallel) as the component 6 may introduce multiple first order resonances.

Figure 3:
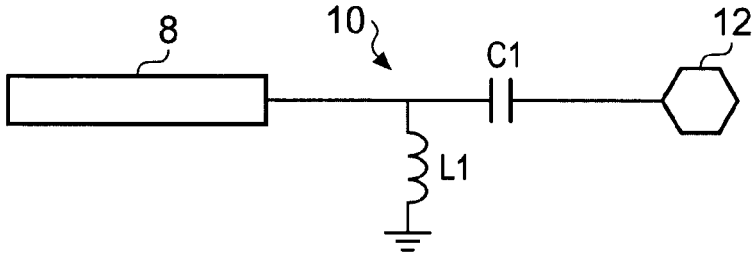
FIG. 3 schematically illustrates matching circuitry.

A schematic example of the matching circuitry 10 is illustrated in FIG. 3. The matching circuit 10, in this example, comprises a series capacitor C1 and a parallel inductor L1. The matching circuit is used to tune the antenna arrangement 2 optimally into dual-resonance in a 50 Ohm environment.

Figure 4A:
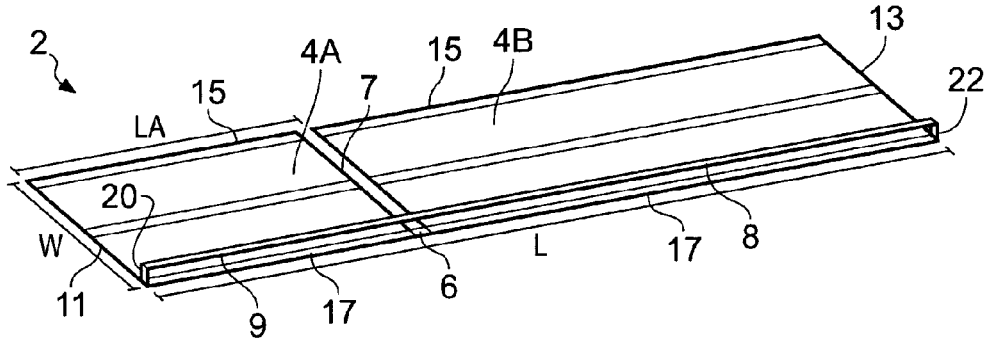
FIG. 4A illustrates a low-profile antenna arrangement.
Figure 4B:
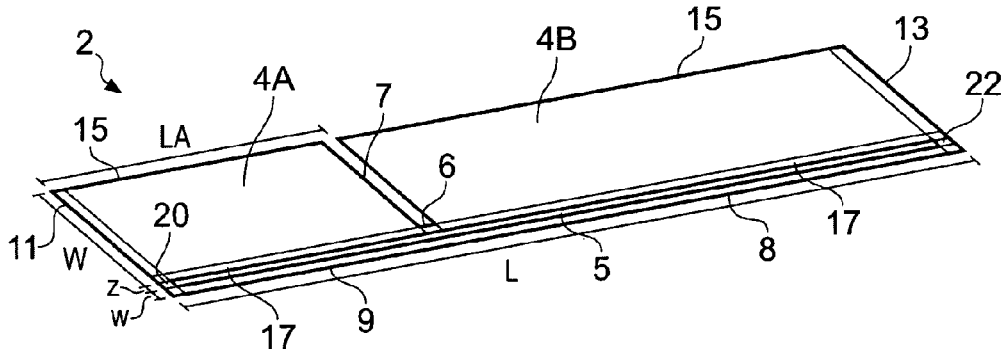
FIG. 4B illustrates a zero-profile antenna arrangement.

FIGS. 4A and 4B illustrate two embodiments of the antenna arrangement 2. FIG. 4A illustrates a low-profile antenna arrangement 2 in which the inductive coupling element 8 overlies the chassis (ground plane) 4. FIG. 4A illustrates a zero-profile antenna arrangement in which the inductive coupling element 8 lies beside the chassis (ground plane) 4.

In these embodiments, the first part 4A of the chassis is planar and lies in a first plane, the second part of the chassis is planar and lies in a second plane. In the illustrated embodiments, which are suitable for use in a mono-block device 3, the first and second planes are co-planar. In other embodiments, such as a folding device 3, the first plane may rotate relative to the second plane.

The planar first part 4A is typically a first multilayer printed circuit (or wiring) board (PCB). The planar second part 4B is typically a second multilayer printed circuit (or wiring) board (PCB). The first and second PCBs may be formed by creating a gap or slot 7 a distance LA from a first 'short' end 11 of a rectangular PCB of length L and width W. The rectangular PCB has two parallel 'long' edges 15, 17 and two parallel 'short' edges 11, 13. The slot 7 extends, in this particular example, parallel to the short edges 11, 13 and perpendicular to the long edges 15, 17 thus splitting the chassis 4 at a point LA along its length from the short edge 11. However, in other examples, the slot 7 may run at an oblique angle to the edges and/or it may curve and/or it may meander.

The position of the slot 7 may affect the resonant modes of the chassis 4. For example, in one embodiment as LA is increased from a small value the bandwidth potential increases and may also increase the resonant frequency of the second resonant mode.

The inductive coupling element 8 is a non-resonant loop element. The loop element 8 has a first extremity 20 and a second extremity 22 and is shorted to the first part 4A of the chassis at the first extremity 20 and electrically connected at the second extremity to the RF feed 12 on the second part 4B via a matching circuit 10.

The inductive coupling loop element 8 is a strip 9 of conductive material that extends parallel to a long edge of the rectangular PCB for its whole length L. The first extremity 20 is at the short edge 11 and the second extremity is at the short edge 13.

In the examples of FIGS. 4A and 4B, a 2 mm slot 7 is positioned at 35 mm along a 40 mm×100 mm chassis 4. Consequently, LA is 35 mm, L is 100 mm and W is 40 mm.

In FIG. 4A, the strip 9 of the inductive coupling loop element 8 extends in a plane that is parallel to the first and second planes and separated therefrom by a separation h in a direction perpendicular to those planes. The strip 9 thus overlies the chassis 4. In the example illustrated, the strip 9 has a constant width (w) along its length (l). It has dimensions 2 mm×2 mm×100 mm (w×h×l). The small dimensions of h make the antenna arrangement 2 low-profile.

In FIG. 4B, the strip 9 of the inductive coupling loop element 8 extends in the co-plane of the first and second parts 4A, 4B. The strip 9 is separated from the first and second parts 4A, 4B by a slot 5 of width z (in a direction perpendicular to the long edge 17 of the chassis 4) that extends parallel to the long edge 17. The strip 9 thus lies in the co-plane of the chassis 4. In the example illustrated, the strip 9 has a constant width (w) along its length (l). It has dimensions 2 mm×100 mm (w×l). The small dimensions of z (2 mm) make the increase in area of the antenna arrangement 2 as a result of the co-planar inductive coupling loop element 8 small.

Figure 5:
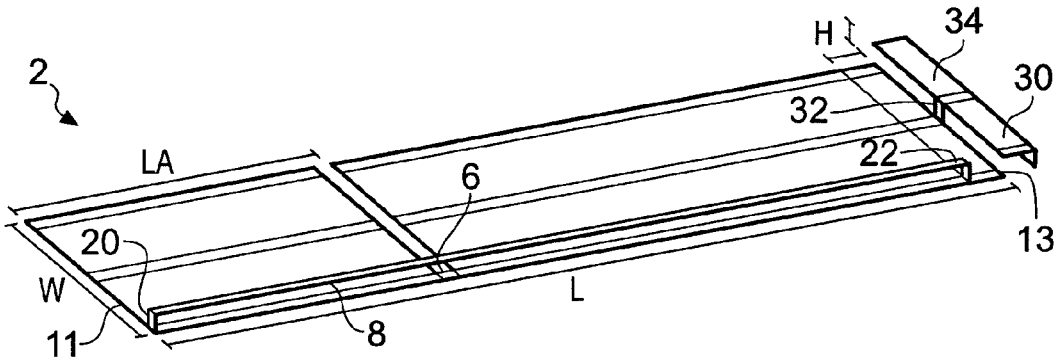
FIG. 5 illustrates a low-profile pentaband antenna arrangement.

FIG. 5 illustrates a pentaband antenna arrangement 2. The arrangement is similar to that illustrated in FIG. 4A. The arrangement 2 additionally comprises a capacitive coupling element 30 positioned at the short edge 13 of the chassis (ground plane) 4.

In this example, the length l of the strip 9 of the inductive coupling loop element 8 is shorter than the length L of the chassis 4. Its length is 95 mm in this example.

Figure 6:
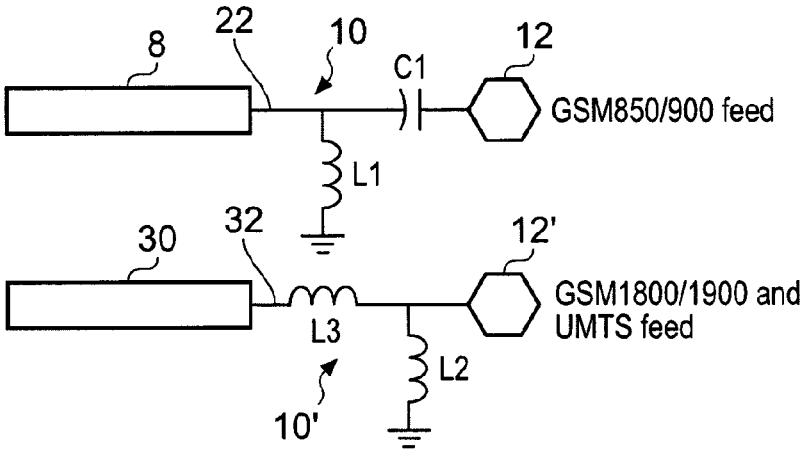
FIG. 6 illustrates a matching circuit for the low-profile pentaband antenna arrangement of FIG. 5.

The capacitive coupling element 30 comprises a substantially planar conductive portion 34 that extends substantially parallel to the second plane of the second part 4B but with a separation above that plane of H (2 mm in this example). The capacitive coupling element 30 overlies the short edge 13 of the second part 4B. The capacitive coupling element 30 is connected 32 to an RF feed 12' via a matching circuit 10'. The matching circuit 10', an example of which is illustrated in FIG. 6, may comprise a series inductor L3 and a parallel inductor L2.

In one implementation, the inductive coupling loop element 8 is used to cover the US-GSM 850 band (824-894 MHz) and the EGSM 900 band (880-960 MHz) and the capacitive coupling element 30 is used to cover PCN/DCS 1800, WCDMA 2100 and PCS1900 bands.

Figure 7:
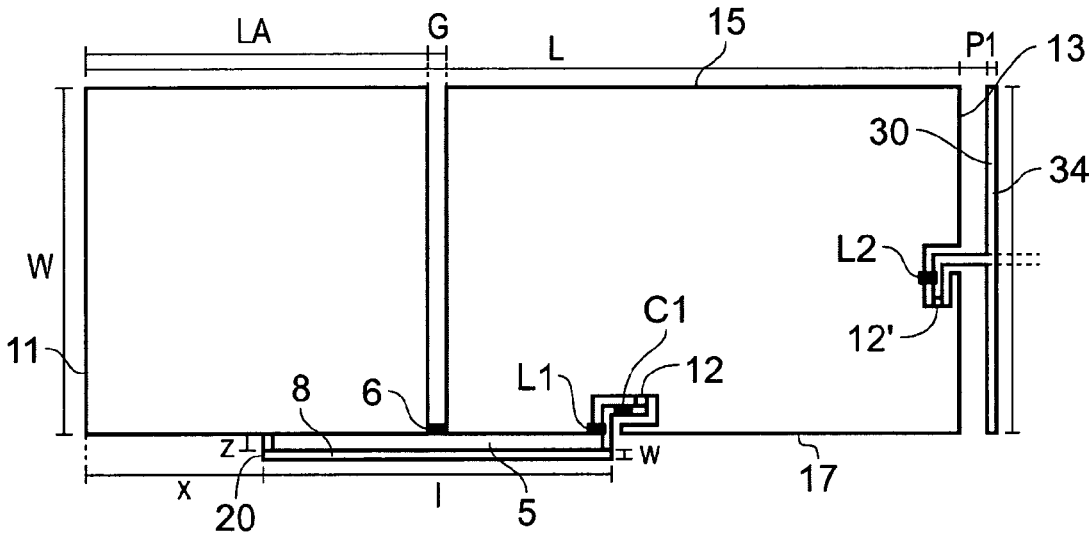
FIG. 7 illustrates a zero-profile pentaband antenna arrangement.

FIG. 7 illustrates a pentaband antenna arrangement 2. The arrangement is similar to that illustrated in FIG. 4B except that the length l of the strip 9 of the inductive coupling loop element 8 is shorter. The extremity 20 is located a distance X from the short edge 11 of the first part 4A, has a length l, a strip width w, and a gap 5 of size z separating it from the first part 4A. In the example illustrated, X is 20 mm, l is 40 mm, z is 2 mm and w is 1 mm.

The antenna arrangement 2 additionally comprises a capacitive coupling element 30 positioned adjacent the short edge 13 of the second part 4B of the chassis 4.

Figure 8:
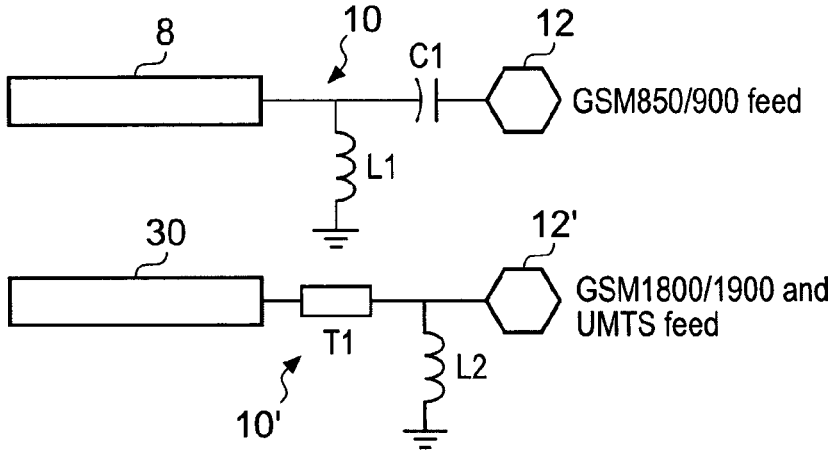
FIG. 8 illustrates a matching circuit for the zero-profile pentaband antenna arrangement of FIG. 7.

The capacitive coupling element 30 comprises a substantially planar conductive portion 34 that extends in the second plane of the second part 4B but with a constant separation p (3 mm in this example). The capacitive coupling element 30 runs parallel to the short edge 13 of the second part 4B but is separated therefrom by a gap of width p. The capacitive coupling element 30 is connected to an RF feed 12' via a matching circuit 10'. The matching circuit 10, an example of which is illustrated in FIG. 8, may comprise a series transmission line T1 and a parallel inductor L2.

In one implementation, the inductive coupling loop element 8 is used to cover the US-GSM 850 band (824-894 MHz) and the EGSM 900 band (880-960 MHz) and the capacitive coupling element 30 is used to cover PCN/DCS 1800, WCDMA 2100 and PCS1900 bands.

Figure 9:
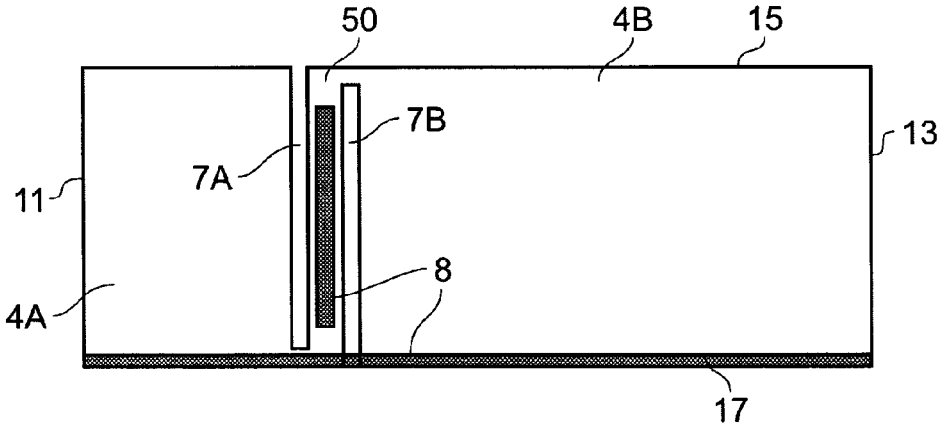
FIG. 9 schematically illustrates an embodiment in which the component is a meander interconnecting the first part and the second part of the chassis.

FIG. 9 schematically illustrates an embodiment in which the component 8 is a meander 50 interconnecting the first part 4A and the second part 4B. The meander is formed by a first slot 7A that extends perpendicularly from the long side 15 of the chassis 4 towards but not to the long side 17 of the chassis and a second slot 7B that extends perpendicularly from the long side 17 of the chassis towards but not to the long side 15 of the chassis 4. The separation S between the slots 7A and 7B forms an interconnecting meander.

The inductive coupling element 8 may be positioned as described previously i.e. extending lengthwise parallel to the edge 17 or may alternatively be positioned so that it overlies the meander 50 and extends width wise between and parallel to the slots 7A and 7B.

Although embodiments of the present invention have been described in the preceding paragraphs with reference to various examples, it should be appreciated that modifications to the examples given can be made without departing from the scope of the invention as claimed. For example:

In the examples illustrated in FIGS. 4A and 4B, a single slot 7 is used to partition the chassis 4 into two parts 4A, 4B. It should be appreciated that the chassis 4 may be partitioned into multiple parts using more than one slot 7.

In the examples illustrated in FIGS. 4A and 4B, a single component is used to interconnect parts of the chassis at one long edge of the chassis and an inductive coupling element 8 is associated with the component at that edge. In other examples (not illustrated), more that one component 8 may be used to interconnect separated parts of the chassis 4 and a different inductive coupling element 8 may be associated with each component. For example a first component 8 and first inductive coupling element may be positioned at a first long edge 17 of the chassis 4 and a second component 6 and second inductive coupling element 8 may be positioned at a second long edge 15 of the chassis 4. The first and second components 8 may span the same or different gaps 7 in the chassis.

Whilst endeavoring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

We claim:

1. An apparatus comprising:

a partitioned ground plane comprising at least a first part and a second part that are interconnected by a component having a predetermined impedance; and an inductive coupling element positioned adjacent the component.

2. The apparatus as claimed in claim 1, wherein the inductive coupling element excites resonant modes of the partitioned ground plane by generating a magnetic field at the component.

3. The apparatus as claimed in claim 1, wherein the inductive coupling element is a loop element.

4. The apparatus as claimed in claim 3, wherein the loop element is non-resonant.

5. The apparatus as claimed in claim 3, wherein the loop element has a first extremity and a second extremity and is shorted to the partitioned ground plane at the first extremity and electrically connected at the second extremity to a RF feed, wherein the first extremity is shorted to the first part of the partitioned ground plane and the RF feed that is connected to the second extremity is associated with the second part of the partitioned ground plane.

6. The apparatus as claimed in claim 1, wherein the component is an inductor having an inductance greater than 3.6 nH.

7. The apparatus as claimed in claim 1, wherein the component is an inductor having an inductance greater than 8 nH.

8. The apparatus as claimed in claim 1, wherein the component is a capacitor.

9. The apparatus as claimed in claim 1, wherein the component is a resonant circuit.

10. The apparatus as claimed in claim 1, wherein the component is a meandering interconnect between the first and second parts.

11. The apparatus as claimed in claim 1, wherein the inductive coupling element is configured to excite a plurality of resonant modes of different order in the partitioned ground plane and wherein, for a lowest one of the resonant modes, the partitioned ground plane operates as an antenna radiator.

12. The apparatus as claimed in claim 1, wherein the first part of the partitioned ground plane has a first physical length and the second part of the partitioned ground plane has a second physical length and the combination of the first part, the component and the second part has an electrical length that is at least 10% different to the combination of the first and second physical lengths.

13. The apparatus as claimed in claim 12, wherein the electrical length is of the order 13 cm.

14. The apparatus as claimed in claim 13, wherein the first part and the second part are co-planar and separated by a gap, wherein the first physical length, the second physical length and the gap in combination are of the order 10 cm.

15. A module for a wireless communication device comprising the apparatus as claimed in claim 1.

16. A portable electronic device comprising the apparatus as claimed in claim 1.

17. An apparatus comprising:

a chassis tuned to a predetermined resonant frequency using an incorporated component having a predetermined impedance; and a conductive element, having a RF feed, positioned adjacent the component.

18. The apparatus as claimed in claim 17, wherein the chassis comprises a first portion and a second portion and the incorporated component electrically connects the first portion and the second portion.

19. A method comprising:

partitioning a ground plane into a first part and a second part interconnecting the first part and the second part using a component having a predetermined impedance; and providing an inductive coupling element adjacent the component.

20. A method comprising:

using an inductive coupling element adjacent a component to excite a resonant mode of a ground plane that is partitioned into first and second parts interconnected via the component.

* * * * *